US008344961B1

(12) United States Patent
Buckley

(10) Patent No.: US 8,344,961 B1
(45) Date of Patent: Jan. 1, 2013

(54) C-BAND RADIATING ELEMENT FOR BROAD AREA MARITIME SURVEILLANCE (BAMS)

(75) Inventor: Michael J. Buckley, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 593 days.

(21) Appl. No.: 12/563,221

(22) Filed: Sep. 21, 2009

(51) Int. Cl.
*H01Q 21/12* (2006.01)

(52) U.S. Cl. ..... 343/812; 343/846; 343/873; 343/909

(58) Field of Classification Search ..... 343/700 MS, 343/795, 810, 812, 816, 846, 873, 909
See application file for complete search history.

(56) References Cited

U.S. PATENT DOCUMENTS 4,477,813 A * 10/1984 Weiss ..... 343/700 MS
4,614,947 A * 9/1986 Rammos ..... 343/778
5,485,167 A * 1/1996 Wong et al. ..... 343/753
7,228,156 B2 * 6/2007 Gilbert ..... 455/562.1

* cited by examiner

*Primary Examiner* — Michael C Wimer
(74) *Attorney, Agent, or Firm* — Donna P. Suchy; Daniel M. Berbieri

(57) ABSTRACT

The present invention is Broad Area Maritime Surveillance (BAMS) radiating element which includes a plurality of dipole layers, a stripline feed layer and a cover portion. The radiating element is low-profile and may have a thickness of 180 mils. Further, the radiating element may have an operating frequency range from 5.35 GHz to 5.46 GHz and a depth of 0.083 free space wavelengths at the high end of the operating frequency range. Still further, the dipoles of the dipole layers of the BAMS radiating element vary in width from layer to layer to maximize match at the edge of the scan volume. The BAMS radiating element may be at least partially constructed of printed circuit board material, such as Rogers 4003. The BAMS radiating element may have a return loss of less than −10 decibels over its entire scan volume and frequency band.

5 Claims, 3 Drawing Sheets

C-BAND RADIATING ELEMENT FOR BROAD AREA MARITIME SURVEILLANCE (BAMS)

FIELD OF THE INVENTION

The present invention relates to the field of Radio Frequency (RF) devices/advanced sensors and particularly to a C-band radiating element for Broad Area Maritime Surveillance (BAMS).

BACKGROUND OF THE INVENTION

A number of current RF devices may not be optimal for implementation in a number of environments.

Thus, it would be desirable to provide a device which obviates the problems associated with current RF devices.

SUMMARY OF THE INVENTION

Accordingly, an embodiment of the present invention is directed to a radiating element, including: a first dipole layer, the first dipole layer including a first plurality of dipoles; a second dipole layer, the second dipole layer including a second plurality of dipoles, the second dipole layer being connected to the first dipole layer; and a stripline feed layer, the stripline feed layer including a stripline feed and a plurality of cores, the stripline feed layer being connected to the first dipole layer and the second dipole layer, wherein dipoles included in the first plurality of dipoles have different widths than dipoles included in the second plurality of dipoles.

An additional embodiment of the present invention is directed to a C-band Broad Area Maritime Surveillance radiating element, including: a first dipole layer, the first dipole layer including a first plurality of dipoles and at least one metamaterial; a second dipole layer, the second dipole layer including a second plurality of dipoles and at least one metamaterial, the dipoles included in the second plurality of dipoles having different widths than dipoles included in the first plurality of dipoles, the second dipole layer being connected to the first dipole layer; a stripline feed layer, the stripline feed layer including a stripline feed and a plurality of cores, the stripline feed layer being connected to the first dipole layer and the second dipole layer, wherein a ground plane surface of the second dipole layer forms a slot via which said second dipole layer is connected to the stripline feed layer; and a cover portion, the cover portion configured for at least substantially covering the first dipole layer, wherein the radiating element is at least partially constructed of printed circuit board material.

A further embodiment of the present invention is directed to a C-band Broad Area Maritime Surveillance radiating element, including: a first dipole layer, the first dipole layer including a first plurality of dipoles and at least one metamaterial; a second dipole layer, the second dipole layer including a second plurality of dipoles and at least one metamaterial, the dipoles included in the second plurality of dipoles having different widths than dipoles included in the first plurality of dipoles, the second dipole layer being connected to the first dipole layer; a stripline feed layer, the stripline feed layer including a stripline feed and a plurality of cores, the stripline feed layer being connected to the first dipole layer and the second dipole layer, wherein a ground plane surface of the second dipole layer forms a slot via which said second dipole layer is connected to the stripline feed layer; and a cover portion, the cover portion configured for at least substantially covering the first dipole layer, wherein the operating frequency range of the radiating element is 5.35 Gigahertz to 5.46 Gigahertz, the radiating element having a depth of 0.083 free space wavelengths at 5.46 Gigahertz.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Referring generally to FIGS. 1-4, a radiating element (ex.—antenna) in accordance with an exemplary embodiment of the present invention is shown. The radiating element 100 may be a Broad Area Maritime Surveillance radiating element. Further, the radiating element 100 may be a C-band (ex.—may have a 4 Gigahertz to 8 Gigahertz (4-8 GHz) operating frequency range) radiating element. In a current embodiment of the present invention, the BAMS radiating element 100 may operate over a frequency range from 5.35 GHz to 5.46 GHz (ex.—the BAMS frequency band). Further, the radiating element 100 may be a wide-scan radiating element. For instance, the radiating element 100 may have a fifty degree, half conical scan angle.

Figure 1:
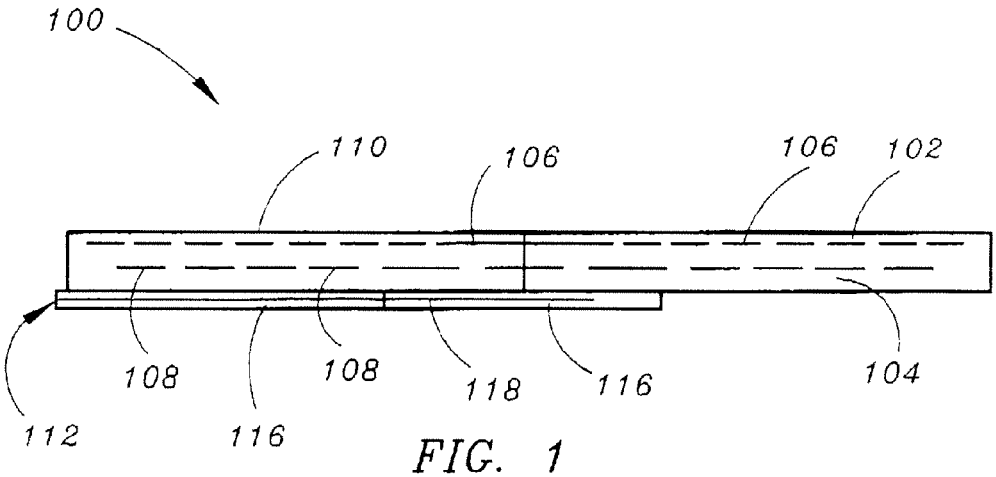
FIG. 1 is a cross-sectional view of a BAMS radiating element in accordance with an exemplary embodiment of the present invention.
Figure 2:
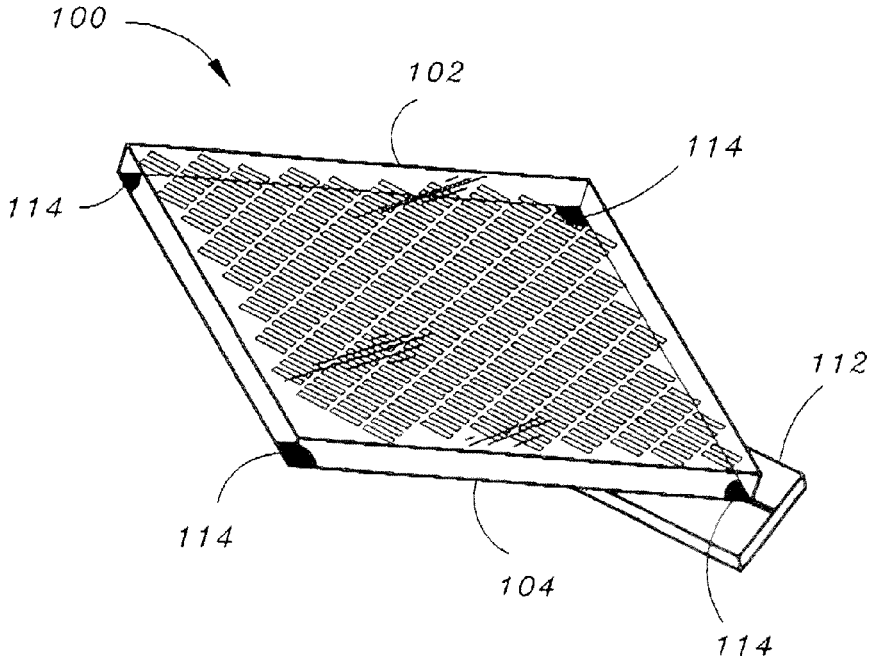
FIG. 2 is an isometric view of the BAMS radiating element of FIG. 1 in accordance with an exemplary embodiment of the present invention.
Figure 3:
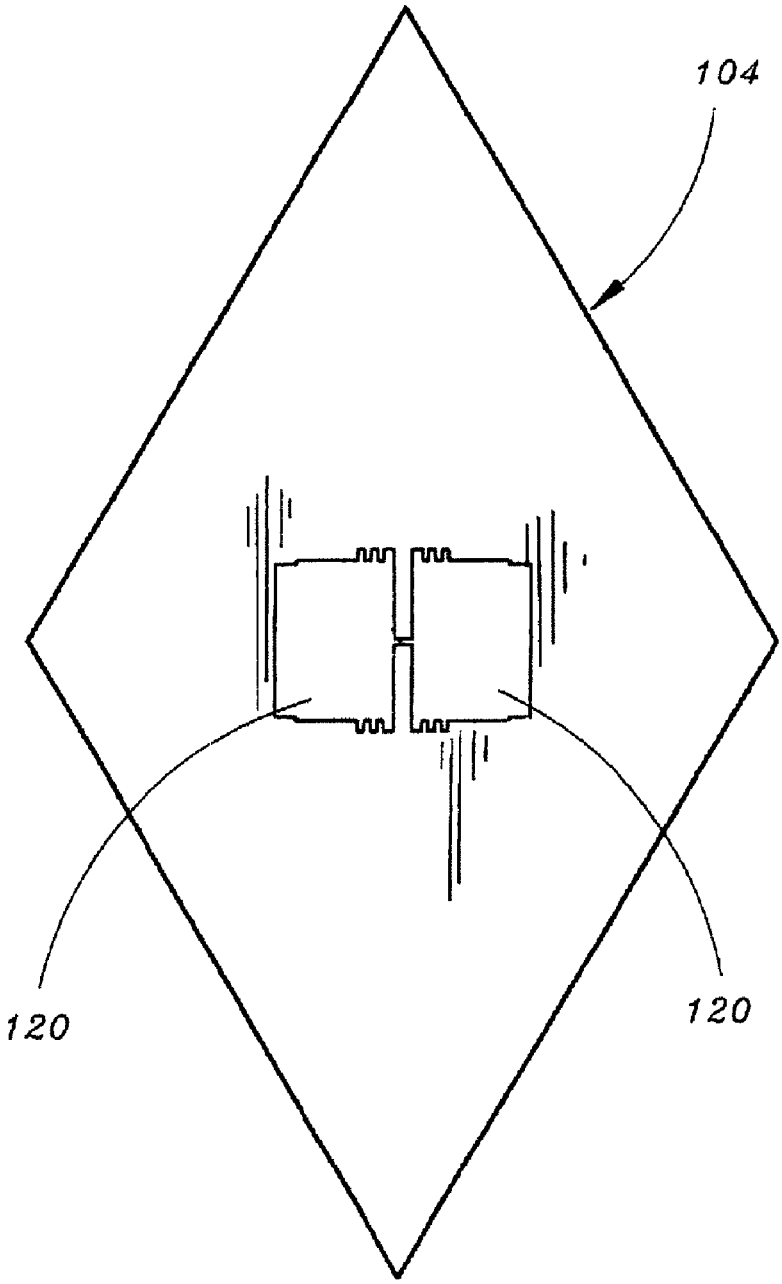
FIG. 3 is a bottom view of a bottom dipole layer of the BAMS radiating element of FIG. 1, said bottom view illustrating a shape of a slot formed in the bottom dipole layer in accordance with an alternative exemplary embodiment of the present invention.
Figure 4:
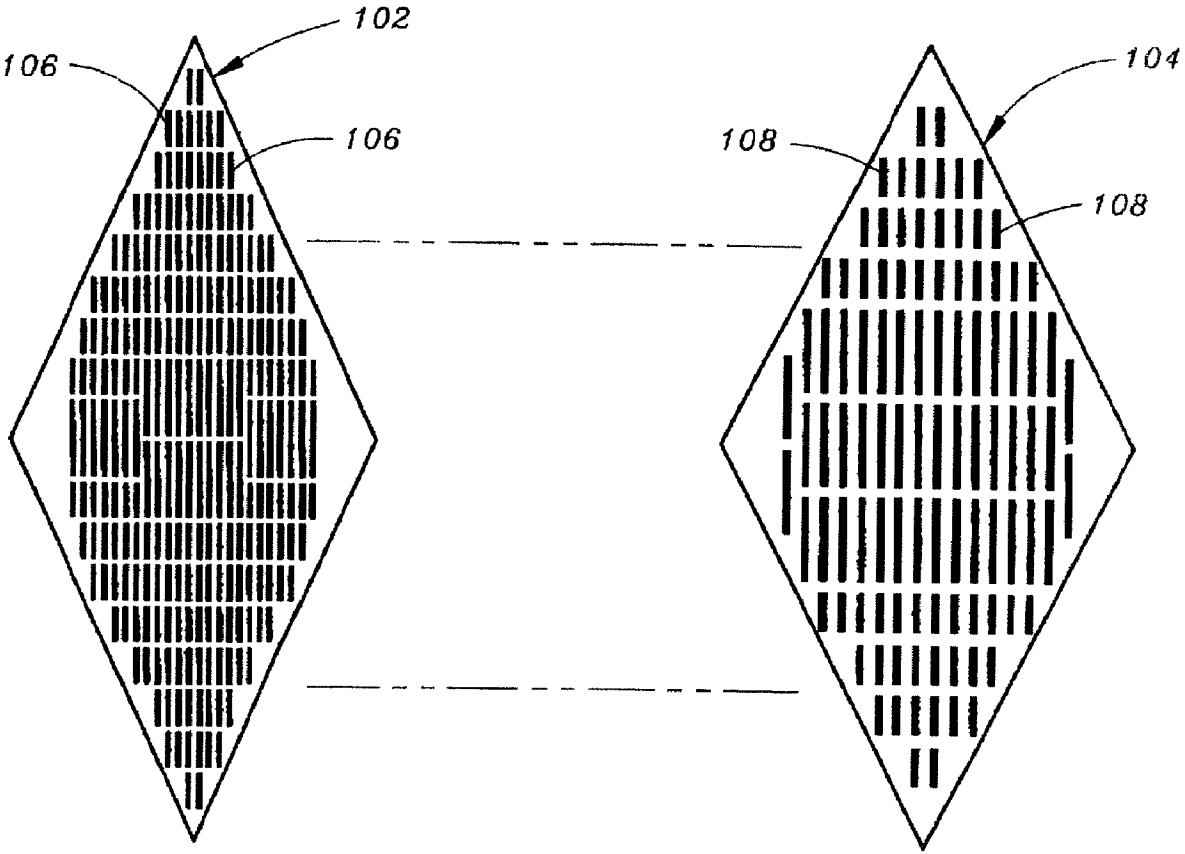
FIG. 4 is a view of a top dipole layer and the bottom dipole layer of the BAMS radiating element of FIG. 1 in accordance with a further alternative exemplary embodiment of the present invention.

In exemplary embodiments, the radiating element 100 may include a plurality of dipole layers/a plurality of layers of dipoles. For example, the radiating element 100 may include a first dipole layer 102 and a second dipole layer 104. Further, the first dipole layer 102 may be a top dipole layer and the second dipole layer 104 may be a bottom dipole layer, with the first dipole layer/top dipole layer 102 being connected to/mounted upon/stacked upon the second dipole layer/bottom dipole layer 104. In further embodiments, the first dipole layer 102 may include metamaterial(s) and a first plurality of dipoles 106, while the second dipole layer 104 may include metamaterial(s) and a second plurality of dipoles 108. Still further, the dipole layers (102, 104) are configured for matching to free space. In current embodiments of the present invention, in order to increase or maximize match (such as in an H plane scan and/or at the edge of a scan volume), the dipoles included in the first plurality of dipoles 106 (the dipoles of the first dipole layer 102) may have varying widths compared to/different widths than the dipoles included in the second plurality of dipoles 108 (the dipoles of the second dipole layer 104) (as shown in FIG. 4). In additional embodiments, the dipole layers (102, 104) may form an array grid/ array lattice which occupies a footprint having the following dimensions: 2160 mils×1248 mils (as shown in FIG. 3). For instance, one mil may be equivalent to 0.001 inches.

In further embodiments, the radiating element 100 may include built-in environmental protection. For example, the radiating element 100 may include a cover portion/cover layer 110. The cover portion 110 may be connected to/may be mounted upon/may at least substantially cover the first/top dipole layer 102. Further, the cover portion 110 may be configured for providing salt fog protection for the top dipole layer 102. In exemplary embodiments, the cover portion 110 may be constructed of printed circuit board material having a thickness of 30 mils. For instance, the printed circuit board material may be Rogers 4003 material and/or may have a dielectric constant of 3.55.

In exemplary embodiments, the radiating element 100 may include a stripline feed layer 112. The stripline feed layer 112 may be connected to the dipole layers (102, 104), such that the dipole layers are stacked/mounted upon (ex.—via screws/screw heads 114) the stripline feed layer 112 (ex.—the stripline feed layer 112 may be in physical contact with bottom dipole layer 104). The stripline feed layer 112 may include a plurality of cores 116 and a stripline feed 118. Further, the cores 116 may be formed of printed circuit board material (ex.—Rogers 4003 material) and may be 2×20 mil cores. In additional embodiments, the bottom dipole layer 104 may form a ground plane for the radiating element 100 and may have a slot 120 formed therein (as shown in FIG. 3) for connecting to the stripline feed layer 112. Because the radiating element 100 is very compact, the shape of the slot 120 is novel.

In further embodiments, the radiating element 100 may be an extremely low profile radiating element. For instance, the radiating element 100 may have a thickness/depth of 180 mils. Further, the radiating element 100 may have a 0.083 free space wavelengths depth at the high end of the BAMS frequency band (ex.—at 5.46 GHz). In contrast, a Ku-band 12-18 GHz radiating element may have 1.83 free space wavelengths depth at the high end of the Ku-band 12-18 GHz radiating element (ex.—at 18 GHz). Thus, the depth of the radiating element 100 may be less than one-half the depth of the Ku-band 12-18 GHz radiating element. For a BAMS system, saving one-tenth of a free space wavelength (ex.—approximately 215 mils) may be significant since there is very little room for the radar system.

In exemplary embodiments, the radiating element 100 may be at least partially constructed of a printed circuit board material, such as Rogers 4003 material, which may have a dielectric constant equal to 3.55. Constructing the In further embodiments, BAMS radiating element 100 (ex.—the array grid of the BAMS radiating element) may be looser than the array grid of the 12-18 GHz radiating element since the scan volume of the BAMS radiating element 100 is smaller. Further, the BAMS radiating element 100 may have less than −10 decibel(s)/dB return loss over its entire scan volume and frequency band.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A C-band Broad Area Maritime Surveillance radiating element, comprising:

a first dipole layer, the first dipole layer including a first plurality of dipoles, each dipole of the first plurality of dipoles having a first dipole width, the first dipole layer further including at least one metamaterial;

a second dipole layer, the second dipole layer including a second plurality of dipoles, each dipole of the second plurality of dipoles having a second dipole width, the first dipole width different from the second dipole width, the second dipole layer further including at least one metamaterial, the second dipole layer being connected to the first dipole layer;

a stripline feed layer, the stripline feed layer including a stripline feed and a plurality of cores, the stripline feed layer being connected to the first dipole layer and the second dipole layer, wherein a slot is formed in a ground plane surface of the second dipole layer, the slot configured to facilitate connection of said second dipole layer to the stripline feed layer; and a cover portion, the cover portion configured for at least substantially covering the first dipole layer, the cover portion further configured for providing salt fog protection for the first dipole layer;

wherein the radiating element is at least partially constructed of printed circuit board material and the first dipole width and the second dipole width are configured to increase match of the radiating element over at least one of: an H plane or an edge of a scan volume.

2. A C-band Broad Area Maritime Surveillance radiating element as claimed in claim 1, wherein the operating frequency range of the radiating element is 5.35 Gigahertz to 5.46 Gigahertz.

3. A C-band Broad Area Maritime Surveillance radiating element as claimed in claim 2, wherein the radiating element has a depth of 0.083 free space wavelengths at 5.46 Gigahertz.

4. A C-band Broad Area Maritime Surveillance radiating element as claimed in claim 2, wherein the printed circuit board material has a dielectric constant of 3.55.

5. A C-band Broad Area Maritime Surveillance radiating element, comprising:

a first dipole layer, the first dipole layer including a first plurality of dipoles, each dipole of the first plurality of dipoles having a first dipole width, the first dipole layer further including at least one metamaterial;

a second dipole layer, the second dipole layer including a second plurality of dipoles, each dipole of the second plurality of dipoles having a second dipole width, the first dipole width different from the second dipole width, the second dipole layer further including at least one metamaterial, the second dipole layer being connected to the first dipole layer;

a stripline feed layer, the stripline feed layer including a stripline feed and a plurality of cores, the stripline feed layer being connected to the first dipole layer and the second dipole layer, wherein a slot is formed through a ground plane surface of the second dipole layer, the slot configured to facilitate the connection of said second dipole layer to the stripline feed layer; and a cover portion, the cover portion configured for at least substantially covering the first dipole layer, the cover portion further configured for providing salt fog protection for the first dipole layer;

wherein the operating frequency range of the radiating element is 5.35 Gigahertz to 5.46 Gigahertz, the radiating element having a depth of 0.083 free space wavelengths at 5.46 Gigahertz.

* * * * *